US011274264B2

(12) United States Patent
Sato

(10) Patent No.: US 11,274,264 B2
(45) Date of Patent: Mar. 15, 2022

(54) LUBRICATING OIL COMPOSITION

(71) Applicant: IDEMITSU KOSAN CO., LTD., Tokyo (JP)

(72) Inventor: Tokue Sato, Ichihara (JP)

(73) Assignee: IDEMITSU KOSAN CO., LTD., Tokyo (JP)

( * ) Notice: Subject to any disclaimer, the term of this patent is extended or adjusted under 35 U.S.C. 154(b) by 0 days.

(21) Appl. No.: 16/977,885

(22) PCT Filed: Mar. 27, 2019

(86) PCT No.: PCT/JP2019/013414
§ 371 (c)(1),
(2) Date: Sep. 3, 2020

(87) PCT Pub. No.: WO2019/189494
PCT Pub. Date: Oct. 3, 2019

(65) Prior Publication Data

US 2021/0002576 A1 Jan. 7, 2021

(30) Foreign Application Priority Data

Mar. 30, 2018 (JP) ..... JP2018-070292

(51) Int. Cl.

| | |
|---|---|
| ***C10M 169/04*** | (2006.01) |
| ***C10M 129/76*** | (2006.01) |
| ***C10M 133/12*** | (2006.01) |
| ***C10M 137/12*** | (2006.01) |
| ***C10M 141/10*** | (2006.01) |
| *C10N 20/00* | (2006.01) |
| *C10N 30/10* | (2006.01) |

(52) U.S. Cl.
CPC ..... *C10M 169/04* (2013.01); *C10M 129/76* (2013.01); *C10M 133/12* (2013.01); *C10M 137/12* (2013.01); *C10M 141/10* (2013.01); *C10M 2203/003* (2013.01); *C10M 2205/0206* (2013.01); *C10M 2207/284* (2013.01); *C10M 2215/26* (2013.01); *C10M 2223/06* (2013.01); *C10N 2020/015* (2020.05); *C10N 2030/10* (2013.01)

(58) Field of Classification Search
CPC ..... C10M 169/04; C10M 129/76; C10M 133/12; C10M 137/12; C10M 141/10; C10M 2203/003; C10M 2205/0206; C10M 2207/284; C10M 2215/26; C10M 2223/06; C10N 2020/0115; C10N 2030/10
See application file for complete search history.

(56) References Cited

U.S. PATENT DOCUMENTS

| | | | | |
|---|---|---|---|---|
| 6,172,014 | B1 | 1/2001 | Meyers | |
| 2006/0069000 | A1 | 3/2006 | Dong et al. | |
| 2009/0300970 | A1 | 12/2009 | Perego et al. | |
| 2011/0218131 | A1* | 9/2011 | Tsujimoto | C10M 169/041 508/382 |
| 2017/0051226 | A1* | 2/2017 | Obrecht | C10M 129/16 |

FOREIGN PATENT DOCUMENTS

| | | | |
|---|---|---|---|
| EP | 2 039 745 | A1 | 3/2009 |
| EP | 2 341 122 | A1 | 7/2011 |
| JP | 2004-182931 | A | 7/2004 |
| JP | 2008-280540 | A | 11/2008 |
| JP | 2010-509472 | A | 3/2010 |
| JP | 2011-162629 | A | 8/2011 |
| JP | 2016-193994 | A | 11/2016 |
| WO | 01/85878 | A2 | 11/2001 |

OTHER PUBLICATIONS

International Search Report dated Jun. 18, 2019 in PCT/JP2019/013414 filed Mar. 27, 2019, 3 pages.
Notice of Reasons for Refusal dated Oct. 26, 2021 in Japanese Patent Application No. 2018-070292 (with English machine translation), 5 pages.
Supplemental European Search Report dated Dec. 8, 2021, in European Patent Application No. 19776512.6 filed Mar. 27, 2019.
Osenbach, "Fast Simulated Distillation Analysis by Modified ASTM D2887, D6352 and D7169", Perkin Elmer, Inc., pp. 1-4, Mar. 22, 2010.

* cited by examiner

*Primary Examiner* — Cephia D Toomer
(74) *Attorney, Agent, or Firm* — Oblon, McClelland, Maier & Neustadt, L.L.P.

(57) ABSTRACT

Provided is a lubricating oil composition containing a mineral base oil (A) having a temperature gradient Δ|Dt| of a distillation temperature between two points of a distillation amount of 2.0% by volume and a distillation amount of 5.0% by volume in a distillation curve of 6.8° C./% by volume or less, and an antioxidant (B) containing an amine-based antioxidant (B1), a phenol-based antioxidant (B2), and a phosphorus-based antioxidant (B3), wherein the content of the component (B3) is 0.06 to 1.0% by mass based on the total amount of the lubricating oil composition. The lubricating oil composition is a long-life lubricating oil composition that maintains excellent oxidation stability even for long-term use in a high-temperature environment, and has a high effect of suppressing the generation of sludge for a long period of time.

20 Claims, No Drawings

LUBRICATING OIL COMPOSITION

TECHNICAL FIELD

The present invention relates to a lubricating oil composition.

BACKGROUND ART

Lubricating oil compositions used in devices such as turbines (steam turbines, gas turbines, and the like), rotary gas compressors, and hydraulic equipment are used while circulating in a system under a high-temperature environment for a long period of time.

When the lubricating oil composition used in these devices is used in a high-temperature environment, the anti-oxidation performance gradually decreases, and it is often difficult to use the lubricating oil composition for a long period of time. Therefore, there is a need for a lubricating oil composition that can satisfactorily maintain oxidation stability even for long-term use in a high-temperature environment. Various developments have been made on a lubricating oil composition that can meet such demands and can be suitably used for turbines, rotary gas compressors, hydraulic equipment, and the like.

For example, PTL 1 discloses a lubricating oil composition for a rotary gas compressor, which contains a lubricant base oil having a viscosity index of 120 or more, phenyl-α-naphthylamine or a derivative thereof, p,p'-dialkykliphenylamine or a derivative thereof, and a viscosity index improver.

According to PTL 1, the lubricating oil composition can be a lubricating oil composition for a rotary gas compressor that achieves both thermal and oxidation stability and sludge resistance at a high level even when used at a high temperature, and at the same time has an excellent energy saving effect.

CITATION LIST

Patent Literature

PTL 1: JP 2011-162629 A

SUMMARY OF INVENTION

Technical Problem

However, the lubricating oil composition described in PTL 1 has room for further improvement from the viewpoint of improving oxidation stability for long-term use in a high-temperature environment.

In addition, a lubricating oil composition used for a turbine, a rotary gas compressor, hydraulic equipment, and the like is also required to have an effect of suppressing the generation of sludge that may be generated with use. In particular, it can be said that the long-term use in a high-temperature environment is an environment in which sludge is easily generated.

In many cases, the generated sludge may cause, for example, damage to a bearing due to heat generation caused by adhesion to the bearing of the rotating body, clogging of a filter provided in a circulation line, and malfunction of a control system caused by deposition of sludge in a control valve.

According to the study by the present inventors, it was found that the lubricating oil composition described in PTL 1 is insufficient in the effect of suppressing the generation of sludge for long-term use in a high-temperature environment.

Therefore, there is a need for a long-life lubricating oil composition that maintains excellent oxidation stability and has a high effect of suppressing the generation of sludge when used for a long period of time in a high-temperature environment.

An object of the present invention is to provide a long-life lubricating oil composition that maintains excellent oxidation stability and has a high effect of suppressing the generation of sludge for a long period of time even for long-term use in a high-temperature environment.

Solution to Problem

The present inventors have found that a lubricating oil composition containing a mineral base oil prepared so that the temperature gradient of a distillation temperature between two points of a distillation amount of 2.0% by volume and a distillation amount of 5.0% by volume in a distillation curve is a predetermined value or less, and an antioxidant containing an amine-based antioxidant, a phenol-based antioxidant, and a predetermined amount of a phosphorus-based antioxidant can solve the above problems, and have completed the present invention.

That is, the present invention provides the following [1] to [7].

[1] A lubricating oil composition containing:

a mineral base oil (A) having a temperature gradient $\Delta|Dt|$ of a distillation temperature of 6.8° C./% by volume or less between two points of a distillation amount of 2.0% by volume and a distillation amount of 5.0% by volume in a distillation curve; and an antioxidant (B) containing an amine-based antioxidant (B1), a phenol-based antioxidant (B2), and a phosphorus-based antioxidant (B3), wherein the content of the component (B3) is 0.06 to 1.0% by mass based on the total amount of the lubricating oil composition.

[2] The lubricating oil composition according to [1], wherein the content ratio [(B2)/(B1)] of the component (B2) to the component (B1) is 0.1 to 5.0 in terms of a mass ratio.

[3] The lubricating oil composition according to [1] or [2], wherein the content ratio [(B3)/(B1)] of the component (B3) to the component (B1) is 0.01 to 0.60 in terms of a mass ratio.

[4] The lubricating oil composition according to any one of [1] to [3], wherein the content of the component (B1) is 0.10 to 3.8% by mass based on the total amount of the lubricating oil composition.

[5] The lubricating oil composition according to any one of [1] to [4], wherein the content of the component (B2) is 0.10% by mass to 3.8% by mass based on the total amount of the lubricating oil composition.

[6] The lubricating oil composition according to any one of [1] to [5], wherein the component (B3) contains a phosphorus atom-containing compound (B31) having a phenol structure.

[7] The lubricating oil composition according to any one of [1] to [6], wherein the content of the component (B) is 0.10 to 4.0% by mass based on the total amount of the lubricating oil composition.

Advantageous Effects of Invention

The lubricating oil composition of the present invention maintains excellent oxidation stability and has a high effect of suppressing the generation of sludge over a long period of time even for long-term use in a high-temperature environment and has a long life.

DESCRIPTION OF EMBODIMENTS (Lubricating Oil Composition)

A lubricating oil composition of the present invention contains a mineral base oil (A) having a temperature gradient Δ|Dt| of a distillation temperature of 6.8° C./% by volume or less between two points of a distillation amount of 2.0% by volume and a distillation amount of 5.0% by volume in a distillation curve; and an antioxidant (B) containing an amine-based antioxidant (B1), a phenol-based antioxidant (B2), and a phosphorus-based antioxidant (B3).

Note that the lubricating oil composition according to one aspect of the present invention may further contain a synthetic oil and a lubricating oil additive other than the antioxidant, as long as the effects of the present invention are not impaired.

In the lubricating oil composition according to one aspect of the present invention, the total content of the component (A) and the component (B) is preferably 70% by mass or more, more preferably 75% by mass or more, still more preferably 80% by mass or more, even more preferably 85% by mass or more, and particularly preferably 90% by mass or more, based on the total amount (100% by mass) of the lubricating oil composition.

Hereinafter, each component that can be contained in the lubricating oil composition according to one aspect of the present invention will be described.

<Mineral Base Oil (A)>

The mineral base oil (A) contained in the lubricating oil composition of the present invention is prepared so that the temperature gradient Δ|Dt| of the distillation temperature between two points of a distillation amount of 2.0% by volume and a distillation amount of 5.0% by volume in a distillation curve (hereinafter, also simply referred to as "temperature gradient Δ|Dt|") is 6.8° C./% by volume or less.

A general mineral oil contains a light component which cannot be removed even by a refining treatment, and the light component changes into an acidic substance with the long-term use to be present to promote the conversion of a substance which causes the generation of sludge into sludge, which may cause a decrease in oxidation stability.

In addition, it is difficult to completely remove the light component even if an excessive purification treatment is performed, and on the contrary, various properties of the obtained lubricating oil composition may be deteriorated.

In addition, it was found that, depending on the structure and molecular weight of the wax component contained in the mineral oil, even if a small amount of light component is present, adverse effects caused by the light component may be suppressed.

Here, the temperature gradient is a parameter in consideration of the relationship between the content of the light component and the state of the mineral oil such as the structure of the wax component.

In the distillation curve of the mineral oil, in the vicinity of the initial boiling point where the distillation amount is less than 2% by volume, the behavior of the distillation curve is unstable, and it is difficult to accurately evaluate the state of the mineral oil.

In addition, when the distillation amount is 10 to 20% by volume, the fluctuation of the distillation curve is stabilized, but the distillation point has already reached the temperature at which the light component is discharged, and thus the state of the mineral oil cannot be accurately evaluated.

On the other hand, the present inventors have focused on the temperature gradient Δ|Dt| of the distillation temperature between two points of a distillation amount of 2.0% by volume and a distillation amount of 5.0% by volume in a distillation curve of the mineral base oil (A).

When the distillation amount is 2.0 to 5.0% by volume, the fluctuation of the distillation curve is stabilized, and the temperature is in a temperature region in which the light component also remains. Therefore, the states of the light component and the wax component of the mineral base oil can be accurately evaluated.

According to the study of the present inventors, it has been found that a lubricating oil composition having more improved oxidation stability than conventional mineral oils can be obtained by using a mineral base oil (A) prepared so that the temperature gradient Δ|Dt| of the distillation temperature between two points of a distillation amount of 2.0% by volume and a distillation amount of 5.0% by volume in a distillation curve is 6.8° C./% by volume or less.

It is considered that such an effect is exhibited because the mineral base oil (A) has a reduced light component, and even if the mineral base oil (A) contains a small amount of the light component, the wax component in the mineral base oil (A) suppresses a harmful effect caused by the light component.

The temperature gradient Δ|Dt| of the mineral base oil (A) used in one aspect of the present invention is preferably 6.5° C./% by volume or less, more preferably 6.3° C./% by volume or less, sill more preferably 6.0° C./% by volume or less, even more preferably 5.0° C./% by volume or less, and usually 0.1° C./% by volume or more, from the viewpoint of obtaining a lubricating oil composition having more excellent oxidation stability.

In the description herein, the temperature gradient Δ|Dt| means a value calculated from the following equation.

Temperature gradientΔ|Dt|(° C./% by volume)=|[distillation temperature(° C.) at which the distillation amount of the mineral base oil becomes5.0% by volume]−[distillation temperature(° C.) at which the distillation amount of the mineral base oil becomes2.0% by volume]|/3.0(% by volume).

The "distillation temperature at which the distillation amount of the mineral base oil becomes 5.0% by volume" and the "distillation temperature at which the distillation amount of the mineral base oil becomes 2.0% by volume" in the above equation are values measured in accordance with ASTM D6352.

The distillation temperature at the distillation amount of 2.0% by volume of the mineral base oil (A) used in one aspect of the present invention is preferably 405 to 510° C., more preferably 410 to 500° C., still more preferably 415 to 490° C., and even more preferably 430 to 480° C.

In addition, the distillation temperature at the distillation amount of 5.0% by volume of the mineral base oil (A) used in one aspect of the present invention is preferably 425 to 550° C., more preferably 430 to 520° C., still more preferably 434 to 500° C., and even more preferably 450 to 490° C.

Examples of the mineral base oil (A) used in the present invention include atmospheric residues obtained by subjecting a crude oil such as a paraffin-based crude oil, an intermediate-based crude oil, and a naphthene-based crude oil to atmospheric distillation; distillates obtained by subjecting such an atmospheric residue to distillation under reduced pressure; mineral oils resulting from subjecting the distillate to one or more treatments of solvent deasphalting, solvent extraction, hydrofinishing, solvent dewaxing, catalytic dewaxing, isomerization dewaxing, and distillation under reduced pressure, and the like; mineral oils (GTL) obtained by isomerizing a wax (GTL wax (Gas to Liquids Wax)) produced by a Fischer-Tropsch process or the like from a natural gas; and the like.

These may be used alone or in combination of two or more kinds thereof.

Among these, the mineral base oil (A) used in one aspect of the present invention is preferably a paraffin-based mineral oil.

The paraffin content (% $C_P$) of the mineral base oil (A) used in one aspect of the present invention is usually 50 or more, preferably 55 or more, more preferably 60 or more, still more preferably 65 or more, and even more preferably 70 or more, and usually 99 or less.

In the description herein, the paraffin content (% $C_P$) means a value measured in accordance with ASTM D-3238 ring analysis (n-d-M method).

Here, in order to adjust the temperature gradient $\Delta|Dt|$ of the mineral base oil (A) to the above-described range, the temperature gradient $\Delta|Dt|$ can be adjusted by appropriately considering the following matters. It should be noted that the following matters are merely examples and preparation may be performed in consideration of matters other than these.

- When crude oil is used as the feedstock oil, it is preferable to use so-called medium crude oil or heavy crude oil classified by API degree, and it is more preferable to use heavy crude oil.
- The number of stages of the distillation column and the reflux flow rate when distilling the feedstock oil are appropriately adjusted.
- When the feedstock oil is distilled, the distillation is performed at a distillation temperature at which the 5% by volume fraction of the distillation curve is 425° C. or higher.
- The feedstock oil is preferably subjected to a refining treatment including a hydroisomerization dewaxing step, and more preferably subjected to a refining treatment including a hydroisomerization dewaxing step and a hydrofinishing step.
- In the hydroisomerization dewaxing step, the supply ratio of the hydrogen gas is preferably 200 to 500 $Nm^3$, more preferably 250 to 450 $Nm^3$, and still more preferably 300 to 400 $Nm^3$ with respect to 1 kiloliter of the feedstock oil to be supplied.
- In the hydroisomerization dewaxing step, the hydrogen partial pressure is preferably 5 to 25 MPa, more preferably 7 to 20 MPa, and still more preferably 10 to 15 MPa.
- The liquid hourly space velocity (LHSV) in the hydroisomerization dewaxing step is preferably 0.2 to 2.0 $hr^{-1}$, more preferably 0.3 to 1.5 $hr^{-1}$, and still more preferably 0.5 to 1.0 $hr^{-1}$.
- The reaction temperature in the hydroisomerization dewaxing step is preferably 250 to 450° C., more preferably 270 to 400° C., and still more preferably 300 to 350° C.

The kinematic viscosity at 40° C. of the mineral base oil (A) used in one aspect of the present invention is preferably 19.8 to 110 $mm^2/s$, more preferably 28.8 to 90.0 $mm^2/s$, still more preferably 35.0 to 80.0 $mm^2/s$, and even more preferably 41.4 to 74.8 $mm^2/s$.

The viscosity index of the mineral base oil (A) used in one aspect of the present invention is preferably 80 or more, more preferably 90 or more, still more preferably 100 or more, and even more preferably 110 or more, and is preferably less than 160, more preferably 155 or less, still more preferably 150 or less, and even more preferably 145 or less.

In the description herein, the "kinematic viscosity" and the "viscosity index" are values measured in accordance with JIS K2283:2000.

In the lubricating oil composition according to one aspect of the present invention, the content of the mineral base oil (A) is preferably 60% by mass or more, more preferably 70% by mass or more, still more preferably 80% by mass or more, and even more preferably 85% by mass or more, and preferably 99.9% by mass or less, more preferably 99.0% by mass or less, and still more preferably 98.0% by mass or less, based on the total amount (100% by mass) of the lubricating oil composition.

<Synthetic Oil>

The lubricating oil composition according to one aspect of the present invention may further contain a synthetic oil as long as the effects of the present invention are not impaired.

Examples of the synthetic oil include poly-α-olefins such as α-olefin homopolymers and α-olefin copolymers (for example, α-olefin copolymers having 8 to 14 carbon atoms such as ethylene-α-olefin copolymers); isoparaffins; various esters such as polyol esters, dibasic acid esters (for example, ditridecyl glutarate), tribasic acid esters (for example, 2-ethylhexyl trimellitate), and phosphoric acid esters; various ethers such as polyphenyl ether; polyalkylene glycols; alkylbenzenes; and alkylnaphthalenes.

In the lubricating oil composition according to one aspect of the present invention, the content of the synthetic oil is preferably 0 to 30% by mass based on the total amount (100% by mass) of the lubricating oil composition.

<Antioxidant (B)>

The antioxidant (B) contained in the lubricating oil composition of the present invention contains an amine-based antioxidant (B1), a phenol-based antioxidant (B2), and a phosphorus-based antioxidant (B3).

The lubricating oil composition containing the amine-based antioxidant (B1) can exhibit excellent anti-oxidation performance in a high-temperature environment.

However, with only the amine-based antioxidant (B1), it is difficult to exhibit the oxidation stability required for lubricating oil compositions intended for long-term use in a high-temperature environment such as turbines, rotary gas compressors, and hydraulic equipment, and a reduction in life becomes a problem. In addition, there is also a problem in the effect of suppressing sludge that may be generated due to use in a high-temperature environment.

On the other hand, as a result of investigations, the present inventors have found that a lubricating oil composition which exhibits high oxidation stability applicable to long-term use in a high-temperature environment and has a longer life than conventional lubricating oil compositions can be obtained by containing the phenol-based antioxidant (B2) and the phosphorus-based antioxidant (B3) together with the amine-based antioxidant (B1). In addition, it was also found that a lubricating oil composition having an excellent sludge suppressing effect can be obtained.

That is, in the present invention, by using the amine-based antioxidant (B1), the phenol-based antioxidant (B2), and the phosphorus-based antioxidant (B3) in combination as the antioxidant (B), the lubricating oil composition has excellent oxidation stability for long-term use in a high-temperature environment, has a longer life than before, and also has an excellent sludge suppressing effect.

In the lubricating oil composition of the present invention, the content of the component (B3) is required to be 0.06 to 1.0% by mass based on the total amount (100% by mass) of the lubricating oil composition.

When the content of the component (B3) is less than 0.06% by mass, oxidation stability becomes insufficient with long-term use in a high-temperature environment. On the other hand, when the content of the component (B3) is more than 1.0% by mass, the amount of sludge generated may increase with long-term use in a high-temperature environment, and insoluble components are likely to precipitate, which may lead to a decrease in storage stability.

From the above viewpoint, the content of the component (B3) in the lubricating oil composition of the present invention is preferably 0.07 to 0.8% by mass, more preferably 0.08 to 0.6% by mass, still more preferably 0.09 to 0.5% by mass, and even more preferably 0.1 to 0.4% by mass, based on the total amount (100% by mass) of the lubricating oil composition.

In the lubricating oil composition according to one aspect of the present invention, the content of the component (B1) is preferably 0.10 to 3.8% by mass, more preferably 0.50 to 3.5% by mass, still more preferably 0.70 to 3.2% by mass, and even more preferably 1.2 to 3.0% by mass, based on the total amount (100% by mass) of the lubricating oil composition.

When the content of the component (B1) is within the above-described range, it is possible to provide a lubricating oil composition which can effectively exhibit excellent anti-oxidation performance, and which maintains excellent oxidation stability for long-term use in a high-temperature environment, and has a long life.

From the above viewpoint, the content ratio of the component (B3) to the component (B1) [(B3)/(B1)] is preferably 0.01 to 0.60, more preferably 0.03 to 0.40, and still more preferably 0.04 to 0.30, in terms of a mass ratio.

In the lubricating oil composition according to one aspect of the present invention, the content of the component (B2) is preferably 0.10 to 3.8% by mass, more preferably 0.30 to 3.5% by mass, still more preferably 0.50 to 3.0% by mass, and even more preferably 0.70 to 2.5% by mass, based on the total amount (100% by mass) of the lubricating oil composition.

When the content of the component (B2) is within the above-described range, it is possible to obtain a lubricating oil composition which is excellent in sludge suppressing effect, maintains excellent oxidation stability for long-term use in a high-temperature environment, and has a long life.

From the above viewpoint, the content ratio of the component (B2) to the component (B1) [(B2)/(B1)] is preferably 0.1 to 5.0, more preferably 0.15 to 4.0, still more preferably 0.2 to 2.5, and even more preferably 0.25 to 1.8, in terms of a mass ratio.

In the lubricating oil composition according to one aspect of the present invention, the content of the component (B) based on the total amount (100% by mass) of the lubricating oil composition is preferably 0.10% by mass or more, more preferably 0.50% by mass or more, still more preferably 1.0% by mass or more, even more preferably 1.5% by mass or more, and particularly preferably 1.8% by mass or more, from the viewpoint of obtaining a lubricating oil composition that can effectively exhibit excellent anti-oxidation performance, maintains excellent oxidation stability for long-term use in a high-temperature environment, and has a long life, and is preferably 4.0% by mass or less, more preferably 3.8% by mass or less, and still more preferably 3.5% by mass or less, from the viewpoint of obtaining a lubricating oil composition having excellent storage stability.

In the lubricating oil composition according to one aspect of the present invention, the component (B) may contain an antioxidant other than the components (B1), (B2), and (B3).

However, in the lubricating oil composition according to one aspect of the present invention, the total content of the components (B1), (B2), and (B3) in the component (B) is preferably 70 to 100% by mass, more preferably 80 to 100% by mass, still more preferably 90 to 100% by mass, and even more preferably 95 to 100% by mass, based on the total amount (100% by mass) of the component (B) contained in the lubricating oil composition, from the viewpoint of obtaining a lubricating oil composition that can effectively exhibit excellent anti-oxidation performance and sludge suppressing effect, maintains excellent oxidation stability for long-term use in a high-temperature environment, and has along life.

(Amine-Based Antioxidant (B1))

The amine-based antioxidant (B1) used in one aspect of the present invention may be any compound having anti-oxidation performance and having an amino group.

However, in the description herein, the compound having an amino group and containing a phosphorus atom shall belong to the component (B3) and is distinguished from the component (B1). That is, the amine-based antioxidant (B1) does not contain a phosphorus atom.

The amine-based antioxidant (B1) may be used alone or in combination of two or more kinds thereof.

The amine-based antioxidant (B1) used in one aspect of the present invention preferably contains one or more selected from a compound (B11) represented by the following general formula (31-1) and a compound (B12) represented by the following general formula (31-2), and more preferably contains both the compound (B11) and the compound (B12), from the viewpoint of obtaining a lubricating oil composition having further improved anti-oxidation performance.

(b1-1)

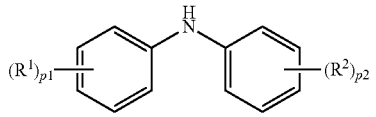

(b1-2)

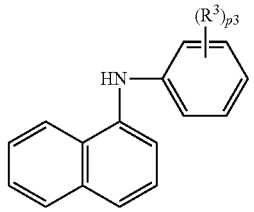

In the general formulas (b1-1) and (b1-2), $R^1$, $R^2$, and $R^3$ each independently represent an alkyl group having 1 to 30 carbon atoms.

In addition, p1, p2, and p3 are each independently an integer of 1 to 5, preferably an integer of 1 to 3, more preferably an integer of 1 to 2, and still more preferably 1.

Note that, for example, when p1 is 2 or more and a plurality of $R^1$'s are present, the plurality of $R^1$'s may be the same or different from each other. The same applies to the case where a plurality of $R^2$'s and $R^3$'s are present.

The number of carbon atoms of the alkyl groups that can be selected as $R^1$ and $R^2$ in the general formula (b1-1) is each independently preferably 1 to 20, more preferably 4 to 16, and still more preferably 4 to 14.

The number of carbon atoms of the alkyl group that can be selected as $R^3$ in the general formula (b1-2) is preferably 1 to 20, more preferably 4 to 16, and still more preferably 6 to 14.

Specific alkyl groups which may be selected as $R^1$, $R^2$, and $R^3$ include, for example, a methyl group, an ethyl group, various propyl groups, various butyl groups, various pentyl groups, various hexyl groups, various heptyl groups, various octyl groups, various nonyl groups, various decyl groups, various undecyl groups, various dodecyl groups, various tridecyl groups, various tetradecyl groups, various pentadecyl groups, various hexadecyl groups, various heptadecyl groups, various octadecyl groups, various nonadecyl groups, various icosyl groups, various henicosyl groups, various docosyl groups, various tricosyl groups, various tetracosyl groups, various pentacosyl groups, various hexacosyl groups, various heptacosyl groups, various octacosyl groups, various nonacosyl groups, various triacontyl groups, various hentriacontyl groups, various dotriacontyl groups, various tritriacontyl groups, various tetratriacontyl groups, various pentatriacontyl groups, various hexatriacontyl groups, various heptatriacontyl groups, various octatriacontyl groups, various nonatriacontyl groups, and various tetracontyl groups.

As used herein, the term "various" refers to all isomers of the alkyl group in question.

The alkyl group may be a linear alkyl group or a branched alkyl group.

In the lubricating oil composition according to one aspect of the present invention, the total content of the compounds (B11) and (B12) in the component (B1) is preferably 80 to 100% by mass, more preferably 90 to 100% by mass, still more preferably 95 to 100% by mass, and even more preferably 98 to 100% by mass, based on the total amount (100% by mass) of the component (B1) contained in the lubricating oil composition.

In the lubricating oil composition according to one aspect of the present invention, the content ratio [(B11)/(B12)] of the compound (B11) and the compound (B12) is preferably 0.5 to 50, more preferably 1 to 40, still more preferably 3 to 30, and even more preferably 5 to 20 in terms of a mass ratio.

(Phenol-Based Antioxidant (B2))

The phenol-based antioxidant (B2) used in one aspect of the present invention may be any compound having anti-oxidation performance and having a phenol structure.

However, in the description herein, the compound having a phenol structure and containing a phosphorus atom shall belong to the component (B3) and is distinguished from the component (B2). That is, the phenol-based antioxidant (B2) is a phenol-based compound containing no phosphorus atom.

The phenol-based antioxidant (B2) may be used alone or in combination of two or more kinds thereof.

The phenol-based antioxidant (B2) used in one aspect of the present invention may be a monocyclic phenol-based compound or a polycyclic phenol-based compound.

Examples of the monocyclic phenol-based compound include 2,6-di-t-butyl-4-methylphenol, 2,6-di-t-butyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl) phenol, 2,6-di-t-amyl-4-methylphenol, and benzenepropanoic acid-3,5-bis(1,1-dimethylethyl)-4-hydroxyalkyl ester.

Examples of the polycyclic phenol-based compound include 4,4'-methylenebis(2,6-di-t-butylphenol), 4,4'-isopropylidenebis(2-di-t-butylphenol), 2,2'-methylenebis(4-methyl-6-t-butylphenol), di-t-butylphenol), 4,4'-bis(2-methyl-6-t-butylphenol), 2,2'-methylenebis(4-ethyl-6-t-butylphenol), and 4,4'-butylidenebis(3-methyl-6-t-butylphenol).

The phenol-based antioxidant (B2) used in one aspect of the present invention is preferably a hindered phenol compound having at least one structure represented by the following formula (b2-0) in one molecule, and more preferably benzenepropanoic acid-3,5-bis(1,1-dimethylethyl)-4-hydroxyalkyl ester or 4,4'-methylenebis(2,6-di-t-butylphenol).

(b2-0)

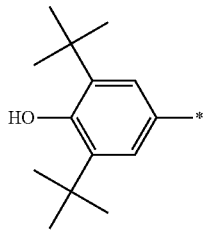

In the above formula (b2-0), * represents a bonding position.

(Phosphorus-Based Antioxidant (B3))

The phosphorus-based antioxidant (B3) used in one aspect of the present invention may be any compound having anti-oxidation performance and containing a phosphorus atom.

In the description herein, as described above, the phosphorus atom-containing compound having an amino group and the phosphorus atom-containing compound having a phenol structure shall belong to the component (B3).

The phosphorus-based antioxidant (B3) may be used alone or in combination of two or more kinds thereof.

Examples of the phosphorus-based antioxidant (B3) include tridecylphosphite, tris(tridecyl)phosphite, triphenylphosphite, trinonylphenylphosphite, bis(tridecyl)pentaerythritol diphosphite, bis(decyl)pentaerythritol diphosphite, tris(2,4-di-t-butylphenyl)phosphite, bis(2,4-di-t-butyl-6-methylphenyl)phosphorous acid ethyl ester, tris(2,4-di-t-butylphenyl)phosphite, 2,2'-methylenebis(4,6-di-t-butyl-1-phenyloxy)(2-ethylhexyloxy)phosphorus, and diethyl 3,5-di-t-butyl-4-hydroxybenzylphosphonate.

The phosphorus-based antioxidant (B3) used in one aspect of the present invention preferably contains a phosphorus atom-containing compound (B31) having a phenol structure, from the viewpoint of obtaining a lubricating oil composition that has excellent oxidation stability for long-term use in a high-temperature environment, has a longer life than before, and also has an excellent sludge suppressing effect.

The compound (B31) is preferably a compound represented by the following general formula (b3-1).

(b3-1)

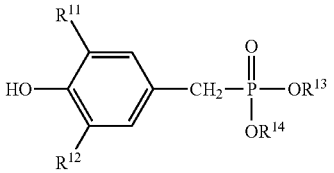

In the above general formula (b3-1), $R^{11}$, $R^{12}$, $R^{13}$, and $R^{14}$ are each independently a hydrogen atom or an alkyl group having 1 to 30 carbon atoms.

Examples of the alkyl group that can be selected as $R^{11}$ to $R^{14}$ include the same alkyl groups as those that can be selected as $R^1$ to $R^3$ described above.

However, the number of carbon atoms of the alkyl group that can be selected as $R^{11}$ to $R^{14}$ is each independently preferably 1 to 20, more preferably 1 to 10, and still more preferably 1 to 6.

In the lubricating oil composition according to one aspect of the present invention, the content of the compound (B31) in the component (B3) is preferably 80 to 100% by mass, more preferably 90 to 100% by mass, still more preferably 95 to 100% by mass, and even more preferably 98 to 100% by mass, based on the total amount (100% by mass) of the component (B3) contained in the lubricating oil composition.

(Other Antioxidant)

The lubricating oil composition according to one aspect of the present invention may contain an antioxidant other than the above-described components (B1), (B2), and (B3) as long as the effects of the present invention are not impaired.

However, from the viewpoint of suppressing the precipitation of sludge generated with long-term use in a high-temperature environment, the content of a metal-based antioxidant in the lubricating oil composition according to one aspect of the present invention is preferably as small as possible, and more preferably substantially no metal-based antioxidant is contained.

Examples of the metal-based antioxidant include zinc-containing antioxidants such as zinc dialkyldithiophosphate.

In the lubricating oil composition according to one aspect of the present invention, the content of the metal-based antioxidant is preferably less than 10 parts by mass, more preferably less than 5 parts by mass, still more preferably less than 1 part by mass, and even more preferably less than 0.1 parts by mass, with respect to 100 parts by mass of the total amount of the component (B) in the lubricating oil composition.

<Additives for Lubricating Oil>

The lubricating oil composition according to one aspect of the present invention may contain an additive for a lubricating oil other than the antioxidant (B) as long as the effects of the present invention are not impaired.

Examples of the additive for lubricating oil include an extreme pressure agent, a detergent dispersant, a viscosity index improver, a rust inhibitor, a metal deactivator, an anti-foaming agent, and a friction modifier.

These additives for lubricating oil may be used alone or in combination of two or more kinds thereof.

In the description herein, additives such as a viscosity index improver and an anti-foaming agent may be blended with other components in the form of a solution dissolved in a diluent oil in consideration of handling property and solubility in the mineral base oil (A). In such a case, in the description herein, the content of the additive such as the anti-foaming agent or the viscosity index improver is a content in terms of an active ingredient (in terms of a resin content) excluding the diluent oil.

Hereinafter, each of the additives for lubricating oil will be described in detail.

(Extreme Pressure Agent)

Examples of the extreme pressure agent include phosphorus-based extreme pressure agents such as phosphate esters, phosphite esters, acidic phosphate esters, and acidic phosphite esters; sulfur-phosphorus-based extreme pressure agents such as thiophosphate esters; halogen-based extreme pressure agents such as chlorinated hydrocarbons; and organometallic extreme pressure agents.

These extreme pressure agents may be used alone or in combination of two or more kinds thereof.

When the lubricating oil composition according to one aspect of the present invention contains an extreme pressure agent, the content of the extreme pressure agent is preferably 0.01 to 10% by mass, more preferably 0.03 to 5% by mass, and still more preferably 0.05 to 1.0% by mass, based on the total amount (100% by mass) of the lubricating oil composition.

(Detergent Dispersant)

Examples of the detergent dispersant include a metal sulfonate, a metal salicylate, a metal phenate, an organic phosphite ester, an organic phosphate ester, an organic phosphate metal salt, succinimide, benzylamine, succinate ester, and a polyhydric alcohol ester.

The metal constituting the metal salt such as the metal sulfonate is preferably an alkali metal or an alkaline earth metal, more preferably sodium, calcium, magnesium, or barium, and still more preferably calcium. The succinimide, benzylamine, and succinate ester may be modified with boron.

When the lubricating oil composition according to one aspect of the present invention contains a detergent dispersant, the content of the detergent dispersant is preferably 0.01 to 10% by mass, more preferably 0.02 to 7% by mass, and still more preferably 0.03 to 5% by mass, based on the total amount (100% by mass) of the lubricating oil composition.

(Viscosity Index Improver)

Examples of the viscosity index improver include polymers such as a non-dispersant-type polymethacrylate, a dispersant-type polymethacrylate, an olefin-based copolymer (for example, an ethylene-propylene copolymer), a dispersant-type olefin-based copolymer, and a styrene-based copolymer (for example, a styrene-diene copolymer, a styrene-isoprene copolymer).

When the lubricating oil composition according to one aspect of the present invention contains a viscosity index improver, the content of the viscosity index improver in terms of a resin content is preferably 0.01 to 10% by mass, more preferably 0.02 to 7% by mass, and still more preferably 0.03 to 5% by mass, based on the total amount (100% by mass) of the lubricating oil composition.

(Rust Inhibitor)

Examples of the rust inhibitor include a metal sulfonate, an alkylbenzenesulfonate, a dinonylnaphthalenesulfonate, an organic phosphite ester, an organic phosphate ester, an organic sulfonic acid metal salt, an organic phosphoric acid metal salt, an alkenyl succinic acid ester, and a polyhydric alcohol ester.

When the lubricating oil composition according to one aspect of the present invention contains a rust inhibitor, the content of the rust inhibitor is preferably 0.01 to 10.0% by mass, and more preferably 0.03 to 5.0% by mass, based on the total amount (100% by mass) of the lubricating oil composition.

(Metal Deactivator)

Examples of the metal deactivator include a benzotriazole compound, a tolyltriazole compound, a thiadiazole compound, an imidazole compound, and a pyrimidine compound.

When the lubricating oil composition according to one aspect of the present invention contains a metal deactivator, the content of the metal deactivator is preferably 0.01 to 5.0% by mass, and more preferably 0.03 to 3.0% by mass, based on the total mass (100% by mass) of the lubricating oil composition.

(Anti-Foaming Agent)

Examples of the anti-foaming agent include a silicone-based anti-foaming agent, a fluorine-based anti-foaming agent such as fluorosilicone oil and fluoroalkyl ether, and a polyacrylate-based anti-foaming agent.

When the lubricating oil composition according to one aspect of the present invention contains an anti-foaming agent, the content of the anti-foaming agent in terms of a resin content is preferably 0.0001 to 0.20% by mass, and more preferably 0.0005 to 0.10% by mass, based on the total mass (100% by mass) of the lubricating oil composition.

(Friction Modifier)

Examples of the friction modifier include molybdenum-based friction modifiers such as molybdenum dithiocarbamate (MoDTC) and molybdenum dithiophosphate (MoDTP); and ash-free friction modifiers having at least one alkyl or alkenyl group having 6 to 30 carbon atoms in the molecule, such as an aliphatic amine, a fatty acid ester, a fatty acid, an aliphatic alcohol, and an aliphatic ether.

When the lubricating oil composition according to one aspect of the present invention contains a friction modifier, the content of the friction modifier is preferably 0.01 to 5.0% by mass based on the total amount (100% by mass) of the lubricating oil composition.

As described above, it is preferable that the friction modifier containing a sulfur atom, such as MoDTC or MoDTP, is not substantially contained from the viewpoint of suppressing the precipitation of sludge generated with long-term use in a high-temperature environment.

(Various Physical Properties of Lubricating Oil Composition)

The kinematic viscosity at 40° C. of the lubricating oil composition according to one aspect of the present invention is preferably 5 to 300 $mm^2/s$, more preferably 10 to 200 $mm^2/s$, and still more preferably 15 to 100 $mm^2/s$.

The viscosity index of the lubricating oil composition according to one aspect of the present invention is preferably 85 or more, more preferably 90 or more, and still more preferably 95 or more.

[Use of Lubricating Oil Composition and Lubricating Method]

The lubricating oil composition according to one aspect of the present invention can be used as a turbine oil used for lubricating various turbines such as a steam turbine, a nuclear turbine, a gas turbine, and a turbine for hydroelectric power generation; a bearing oil, a gear oil, and a control system hydraulic oil used for lubricating various turbomachines such as a blower and a rotary gas compressor; a hydraulic oil, a lubricating oil for an internal combustion engine, and the like.

That is, the lubricating oil composition of the present invention is preferably used for lubricating various turbines, various turbomachines, hydraulic equipment, and the like.

EXAMPLES

Next, the present invention will be described more specifically with reference to examples, but the present invention is not limited to these examples.

[Method for Measuring Various Physical Properties]

(1) Kinematic Viscosity and Viscosity Index

The kinematic viscosity and the viscosity index were measured and calculated in accordance with JIS K2283: 2000.

(2) Distillation Temperatures at Distillation Amount of 2.0% by Volume and 5.0% by Volume The distillation temperatures at a distillation amount of 2.0% volume and a distillation amount of 5.0% by volume were measured by distillation gas chromatography in accordance with ASTM D6352.

(3) Paraffin Content (% $C_P$)

The paraffin content was measured in accordance with ASTM D-3238 ring analysis (n-d-M method).

(4) Acid Value

The acid value was measured in accordance with JIS K2501 (indicator method).

Production Example 1 (Preparation of Mineral Base Oil (A-1))

The feedstock oil which is a fraction oil of 200 neutral or higher was subjected to a hydroisomerization dewaxing treatment, then further subjected to a hydrofinishing treatment, and then distilled at a distillation temperature such that the 5% by volume fraction on the distillation curve was 460° C. or higher, and a fraction having a kinematic viscosity at 40° C. in the range of 19.8 to 50.6 $mm^2/s$ was collected to prepare a mineral base oil (A-1).

The conditions of the hydroisomerization dewaxing treatment are as follows.

Hydrogen-gas supply ratio: 300 to 400 $Nm^3$ with respect to 1 kiloliter of feedstock oil to be supplied.

Hydrogen partial pressure: 10 to 15 MPa.

Liquid hourly space velocity (LHSV): 0.5 to 1.0 $hr^{-1}$.

Reaction temperature: 300 to 350° C.

Various properties of the obtained mineral base oil (A-1) were as follows. Distillation temperature at distillation amount of 2.0% by volume: 451.0° C.

Distillation temperature at distillation amount of 5.0% by volume: 464.0° C.

Temperature gradient $\Delta|Dt|$=4.3° C./% by volume Kinematic viscosity at 40° C.=43.75 $mm^2/s$ Viscosity index=143

Paraffin content (% $C_P$)=94.1

Production Example 2 (Preparation of Mineral Base Oil (a-1))

A mineral base oil (a-1) was prepared in the same manner as in Production Example 1, except that the paraffin-based mineral oil was distilled at a distillation temperature such that the 5% by volume fraction on the distillation curve was 400° C. or higher, and a fraction having a kinematic viscosity at 40° C. in the range of 19.8 to 50.6 $mm^2/s$ was collected.

Various properties of the obtained mineral base oil (a-1) were as follows.

Distillation temperature at distillation amount of 2.0% by volume: 383.1° C.

Distillation temperature at distillation amount of 5.0% by volume: 404.0° C.

Temperature gradient Δ|Dt|=7.0° C./% by volume

Kinematic viscosity at 40° C.=34.96 $mm^2/s$

Viscosity index=119

Paraffin content (% $C_P$)=74.7

Examples 1 to 5 and Comparative Examples 1 to 8

The following base oils, antioxidants, and various additives were blended in the blending amounts shown in Tables 1 and 2 and sufficiently mixed to prepare each of lubricating oil compositions (X1) to (X5) and (Y1) to (Y8). Details of the base oils, antioxidants, and various additives used are as follows.

<Base Oil>

"Mineral base oil (A-1)": The mineral base oil prepared in Production Example 1.

"PAO(1)": Poly-α-olefin having a kinematic viscosity at 40° C. of 30.8 $mm^2/s$ and a viscosity index of 138.

"Mineral base oil (a-1)": The mineral base oil prepared in Production Example 2.

<Antioxidant>

"Amine-based AO (B1-1)": di(octylphenyl)amine, a compound represented by the general formula (b1-1) in which $R^1$ and $R^2$ represent an octyl group and p=p2=1.

"Amine-based AO (B1-2)": octylphenyl-α-naphthylamine, a compound represented by the general formula (b1-2) in which $R^3$ is an octyl group and p3=1.

"Phenol-based AO (B2-1)": benzenepropanoic acid-3,5-bis(1,1-dimethylethyl)-4-hydroxyalkyl ester.

"Phosphorus-based AO (B3-1)": diethyl dialkyl-4-hydroxybenzyl phosphonate.

<Various Additives>

"Extreme pressure agent": dithiophosphoric acid ester.

"Metal-based detergent dispersant": a mixture of calcium salicylate and calcium sulfonate.

"Viscosity index improver": polymethacrylate-based viscosity index improver.

"Rust inhibitor": alkenyl succinic acid polyhydric alcohol ester.

"Copper deactivator": N-dialkylaminomethylbenzotriazole.

"Anti-foaming agent": a silicone-based anti-foaming agent having a resin content concentration of 1% by mass.

TABLE 1

| | | | Example 1 | Example 2 | Example 3 | Example 4 | Example 5 |
|---|---|---|---|---|---|---|---|
| Lubricating oil composition | | | (X1) | (X2) | (X3) | (X4) | (X5) |
| Base oils | Mineral base oil (A-1) | % by mass | 96.70 | 96.50 | 96.30 | 96.40 | 96.70 |
| | PAO (1) | % by mass | | | | | |
| | Mineral base oil (a-1) | % by mass | | | | | |
| Antioxidants | Amine-based AO (B1-1) | % by mass | 2.00 | 2.00 | 2.00 | 2.00 | |
| | Amine-based AO (B1-2) | % by mass | | | 0.20 | 0.20 | 1.00 |
| | Phenol-based AO (B2-1) | % by mass | 1.00 | 1.00 | 1.00 | 1.00 | 2.00 |
| | Phosphorus-based AO (B3-1) | % by mass | 0.10 | 0.10 | 0.10 | 0.10 | 0.10 |
| Other additives | Extreme pressure agent | % by mass | | 0.10 | 0.10 | 0.10 | |
| | Metal-based detergent dispersant | % by mass | | | | | |
| | Viscosity index improver | % by mass | | 0.10 | 0.10 | | |
| | Rust inhibitor | % by mass | 0.05 | 0.05 | 0.05 | 0.05 | 0.05 |
| | Copper deactivator | % by mass | 0.05 | 0.05 | 0.05 | 0.05 | 0.05 |
| | Anti-foaming agent | % by mass | 0.10 | 0.10 | 0.10 | 0.10 | 0.10 |
| Total | | % by mass | 100.00 | 100.00 | 100.00 | 100.00 | 100.00 |
| Content of antioxidant [% by mass] relative to the total amount of lubrication oil composition (100% by mass) | | | 3.10 | 3.10 | 3.30 | 3.30 | 3.10 |
| Content ratio of phenol-based AO to amine-based AO [phenol-based AO/amine-based AO] (mass ratio) | | | 0.50 | 0.50 | 0.45 | 0.45 | 2.00 |
| Content ratio of phosphorus-based AO to amine-based AO [phosphorus-based AO/amine-based AO] (mass ratio) | | | 0.05 | 0.05 | 0.05 | 0.05 | 0.10 |

TABLE 2

| | | | Comparative Example 1 | Comparative Example 2 | Comparative Example 3 | Comparative Example 4 | Comparative Example 5 |
|---|---|---|---|---|---|---|---|
| Lubricating oil composition | | | (Y1) | (Y2) | (Y3) | (Y4) | (Y5) |
| Base oils | Mineral base oil (A-1) | % by mass | | | 97.02 | 97.80 | 96.80 |
| | PAO (1) | % by mass | 97.02 | | | | |
| | Mineral base oil (a-1) | % by mass | | 96.97 | | | |
| Antioxidants | Amine-based AO (B1-1) | % by mass | 2.00 | 2.00 | 2.00 | 1.00 | 2.00 |
| | Amine-based AO (B1-2) | % by mass | 0.50 | 0.50 | 0.50 | 1.00 | |
| | Phenol-based AO (B2-1) | % by mass | | | | | 1.00 |
| | Phosphorus-based AO (B3-1) | % by mass | 0.20 | 0.20 | 0.20 | | |
| Other additives | Extreme pressure agent | % by mass | | | | | |
| | Metal-based detergent dispersant | % by mass | 0.13 | 0.13 | 0.13 | | |
| | Viscosity index improver | % by mass | | 0.05 | | | |
| | Rust inhibitor | % by mass | | | | 0.05 | 0.05 |
| | Copper deactivator | % by mass | 0.05 | 0.05 | 0.05 | 0.05 | 0.05 |
| | Anti-foaming agent | % by mass | 0.10 | 0.10 | 0.10 | 0.10 | 0.10 |
| Total | | % by mass | 100.00 | 100.00 | 100.00 | 100.00 | 100.00 |

TABLE 2-continued

| | | | | | |
|---|---|---|---|---|---|
| Content of antioxidant [% by mass] relative to the total amount of lubrication oil composition (100% by mass) | 2.70 | 2.70 | 2.70 | 2.00 | 3.00 |
| Content ratio of phenol-based AO to amine-based AO [phenol-based AO/amine-based AO] (mass ratio) | 0 | 0 | 0 | 0 | 0.50 |
| Content ratio of phosphorus-based AO to amine-based AO [phosphorus-based AO/amine-based AO] (mass ratio) | 0.08 | 0.08 | 0.08 | 0 | 0 |

| | | | Comparative Example 6 | Comparative Example 7 | Comparative Example 8 |
|---|---|---|---|---|---|
| Lubricating oil composition | | | (Y6) | (Y7) | (Y8) |
| Base oils | Mineral base oil (A-1) | % by mass | 96.75 | 96.80 | 96.80 |
| | PAO (1) | % by mass | | | |
| | Mineral base oil (a-1) | % by mass | | | |
| Antioxidants | Amine-based AO (B1-1) | % by mass | 2.00 | 1.00 | |
| | Amine-based AO (B1-2) | % by mass | | | 1.00 |
| | Phenol-based AO (B2-1) | % by mass | 1.00 | 2.00 | 2.00 |
| | Phosphorus-based AO (B3-1) | % by mass | 0.05 | | |
| Other additives | Extreme pressure agent | % by mass | | | |
| | Metal-based detergent dispersant | % by mass | | | |
| | Viscosity index improver | % by mass | | | |
| | Rust inhibitor | % by mass | 0.05 | 0.05 | 0.05 |
| | Copper deactivator | % by mass | 0.05 | 0.05 | 0.05 |
| | Anti-foaming agent | % by mass | 0.10 | 0.10 | 0.10 |
| Total | | % by mass | 100.00 | 100.00 | 100.00 |
| Content of antioxidant [% by mass] relative to the total amount of lubrication oil composition (100% by mass) | | | 3.05 | 3.00 | 3.00 |
| Content ratio of phenol-based AO to amine-based AO [phenol-based AO/amine-based AO] (mass ratio) | | | 0.50 | 2.00 | 2.00 |
| Content ratio of phosphorus-based AO to amine-based AO [phosphorus-based AO/amine-based AO] (mass ratio) | | | 0.03 | 0 | 0 |

Each of the prepared lubricating oil compositions (X1) to (X5) and (Y1) to (Y8) was subjected to the following tests. The results are shown in Tables 3-1 to 3-5, Tables 4-1 to 4-4, and Tables 5-1 to 5-4.

(1) Panel Coking Test

In accordance with Fed. Test Method Std. 791-3462, the weight of a panel treated at a panel temperature of 260° C. and an oil temperature of 100° C. in a cycle of a splash time of 15 seconds and a stop time of 45 seconds for each time shown in each table was measured using a panel coking tester, and the amount of coking adhered to the panel was measured from the difference from the panel weight before the test.

(2) Oxidation Stability Test (Dry-TOST)

An oxidation stability test (Dry-TOST method) was performed at 260° C. in accordance with ASTM D7873, and the kinematic viscosity at 40° C., the acid value, the Millipore value (sludge generation amount), and the RPVOT value in accordance with ASTM D2272 for each time shown in each table were measured.

The kinematic viscosity and the acid value were measured in accordance with the above-described standards.

The Millipore value was measured in accordance with ASTM D7873 using a membrane filter manufactured by Millipore Corporation having an average pore diameter of 1.0 μm.

TABLE 3-1

| Example 1 | | Lubricating oil composition (X1) | | | |
|---|---|---|---|---|---|
| Test time | hour | 0 | 167.5 | 193.3 | 220.5 |
| Amount of coking | mg/100 ml | 0 | 10.9 | 11.5 | 4.4 |
| Kinematic viscosity at 40° C. | $mm^2/s$ | 46.11 | 47.53 | 47.14 | 46.52 |
| Acid value | mgKOH/g | 0.03 | 0.78 | 0.49 | 0.22 |
| Millipore value | mg/100 ml | 0 | 1.6 | 1.4 | 3.2 |
| RPVOT value | min | 1563 | 779 | 700 | 587 |

TABLE 3-2

| Example 2 | | Lubricating oil composition (X2) | | | |
|---|---|---|---|---|---|
| Test time | hour | 0 | 190.9 | 214.3 | 238.3 |
| Amount of coking | mg/100 ml | 0 | 5.3 | 19.6 | 54 |
| Kinematic viscosity at 40° C. | $mm^2/s$ | 45.95 | 47.13 | 46.95 | 47.98 |
| Acid value | mgKOH/g | 0.27 | 0.52 | 0.51 | 1.23 |
| Millipore value | mg/100 ml | 0 | 2.4 | 8.2 | 10 |
| RPVOT value | min | 1114 | 787 | 751 | 201 |

TABLE 3-3

| Example 3 | | Lubricating oil composition (X3) | | | | |
|---|---|---|---|---|---|---|
| Test time | hour | 0 | 160.9 | 191.3 | 214.3 | 234.3 |
| Amount of coking | mg/100 ml | 0 | 14.2 | 12.9 | 39 | 72.9 |
| Kinematic viscosity at 40° C. | $mm^2/s$ | 45.87 | 47.14 | 46.68 | 47.89 | 47.68 |
| Acid value | mgKOH/g | 0.26 | 0.35 | 0.42 | 0.72 | 0.86 |
| Millipore value | mg/100 ml | 0 | 2.9 | 6.1 | 5.5 | 18 |
| RPVOT value | min | 1720 | 1030 | 849 | 400 | 336 |

TABLE 3-4

| Example 4 | | Lubricating oil composition (X4) | | | | |
|---|---|---|---|---|---|---|
| Test time | hour | 0 | 162 | 191.5 | 215.3 | 238.1 |
| Amount of coking | mg/100 ml | 0 | 14.6 | 23.3 | 49 | 88.6 |
| Kinematic viscosity at 40° C. | $mm^2/s$ | 45.71 | 46.5 | 46.63 | 47.15 | 47.72 |
| Acid value | mgKOH/g | 0.27 | 0.51 | 0.48 | 0.87 | 0.61 |
| Millipore value | mg/100 ml | 0 | 7.1 | 3.6 | 16 | 3.5 |
| RPVOT value | min | 1769 | 960 | 1061 | 375 | 403 |

TABLE 3-5

| Example 5 | | Lubricating oil composition (X5) | | | | |
|---|---|---|---|---|---|---|
| Test time | hour | 0 | 117.9 | 165.9 | 210 | 238.3 |
| Amount of coking | mg/100 ml | 0 | 5.4 | 6.8 | 13.4 | 50.2 |
| Kinematic viscosity at 40° C. | $mm^2/s$ | 44.9 | 45.2 | 45.75 | 46.22 | 74.64 |
| Acid value | mgKOH/g | 0.14 | 0.12 | 0.28 | 0.42 | 13.9 |
| Millipore value | mg/100 ml | 0 | 0 | 1.5 | 1.2 | 2.2 |
| RPVOT value | min | 705 | 571 | 427 | 311 | 13 |

TABLE 4-1

| Comparative Example 1 | | Lubricating oil compostion (Y1) | | | | | | |
|---|---|---|---|---|---|---|---|---|
| Test time | hour | 0 | 142.2 | 165.4 | 190.6 | 195.1 | 215.1 | 243.3 |
| Amount of coking | mg/100 ml | 0 | 6.6 | 9.5 | 32.2 | 13.2 | 48 | 44 |
| Kinematic viscosity at 40° C. | $mm^2/s$ | 36.11 | 38.08 | 39.48 | 42.97 | 40.03 | 47.94 | 52.1 |
| Acid value | mgKOH/g | 0.09 | 0.47 | 0.9 | 2.24 | 2.02 | 3.96 | 5.51 |
| Millipore value | mg/100 ml | 0 | 0.3 | 0.1 | 0.8 | 0.1 | 0.7 | 0.6 |
| RPVOT value | min | 2008 | 674 | 318 | 120 | 305 | 25 | 18 |

TABLE 4-2

| Comparative Example 2 | | Lubricating oil composition (Y2) | | | | | | |
|---|---|---|---|---|---|---|---|---|
| Test time | hour | 0 | 45.4 | 71.6 | 86.4 | 99.1 | 126.3 | 147.6 |
| Amount of coking | mg/100 ml | 0 | 1.6 | 2.8 | 17.8 | 19.3 | 20.9 | 104.4 |
| Kinematic viscosity at 40° C. | $mm^2/s$ | 44.46 | 45.16 | 45.47 | 46.94 | 48.06 | 50.08 | 53.76 |
| Acid value | mgKOH/g | 0.07 | 0.07 | 0.1 | 0.45 | 0.66 | 1.03 | 2.55 |
| Millipore value | mg/100 ml | 0 | 0.4 | 0.3 | 0.5 | 0.8 | 0.5 | 0.3 |
| RPVOT value | min | 1741 | 1706 | 1477 | 580 | 374 | 249 | 94 |

TABLE 4-3

| Comparative Example 3 | | Lubricating oil compostion (Y3) | | | | | | | | | |
|---|---|---|---|---|---|---|---|---|---|---|---|
| Test time | hour | 0 | 29.2 | 44.7 | 53.4 | 72 | 86 | 100 | 134.2 | 146 | 156.9 |
| Amount of coking | mg/100 ml | 0 | 0.7 | 1.5 | 4.9 | 7.4 | 16.9 | 19.5 | 18.2 | 39.4 | 123.5 |
| Kinematic viscosity at 40° C. | $mm^2/s$ | 45.11 | 45.08 | 45.28 | 45.22 | 51.11 | 48.86 | 55.33 | 52.62 | 58.19 | 67.03 |

TABLE 4-3-continued

| Comparative Example 3 | | Lubricating oil compostion (Y3) | | | | | | | | | |
|---|---|---|---|---|---|---|---|---|---|---|---|
| Acid value | mgKOH/g | 0.09 | 0.08 | 0.14 | 0.1 | 2.59 | 1.44 | 4.41 | 4.56 | 6.91 | 10.8 |
| Millipore value | mg/100 ml | 0 | 0.3 | 0.3 | 0.6 | 2.2 | 0.5 | 1 | 0.5 | 1.3 | 1.2 |
| RPVOT value | min | 2238 | 2162 | 1724 | 2081 | 98 | 194 | 25 | 36 | 17 | 17 |

TABLE 4-4

| Comparative Example 4 | | Lubricating oil composition (Y4) | | | | | | |
|---|---|---|---|---|---|---|---|---|
| Test time | hour | 0 | 22.2 | 47.7 | 71.1 | 86.4 | 137.6 | 166 |
| Amount of coking | mg/100 ml | 0 | 5.1 | 35.4 | 180.6 | 169.5 | 425.5 | 579.4 |
| Kinematic viscosity at 40° C. | $mm^2/s$ | 45 | 45.11 | 47.45 | | 50.4 | 50.5 | 54.52 |
| Acid value | mgKOH/g | 0.07 | 0.45 | 1.23 | 3.25 | 3.38 | 3.61 | 5.56 |
| Millipore value | mg/100 ml | 0 | 6.6 | 4 | 2 | 2.3 | 0.3 | 0.2 |
| RPVOT value | min | 1780 | 1231 | 299 | 22 | 22 | 21 | 21 |

TABLE 5-1

| Comparative Example 5 | | Lubricating oil composition (Y5) | | | |
|---|---|---|---|---|---|
| Test time | hour | 0 | 118.1 | 125.7 | 163.4 |
| Amount of coking | mg/100 ml | 0 | 6.9 | 74.2 | 379.8 |
| Kinematic viscosity at 40° C. | $mm^2/s$ | 45.68 | 48.17 | 49.76 | 56.22 |
| Acid value | mgKOH/g | 0.12 | 1.02 | 1.92 | 5.72 |
| Millipore value | mg/100 ml | 0 | 0.7 | 1.4 | 0.2 |
| RPVOT value | min | 1504 | 432 | 208 | 27 |

TABLE 5-2

| Comparative Example 6 | | Lubricating oil composition (Y6) | | |
|---|---|---|---|---|
| Test time | hour | 0 | 167.1 | 210 |
| Amount of coking | mg/100 ml | 0 | 28.1 | 305 |
| Kinematic viscosity at 40° C. | $mm^2/s$ | 45.78 | 56.43 | 59 |
| Acid value | mgKOH/g | 0.13 | 5.33 | 7.36 |
| Millipore value | mg/100 ml | 0 | 0.6 | 0.1 |
| RPVOT value | min | 1463 | 14 | 22 |

TABLE 5-3

| Comparative Example 7 | | Lubricating oil composition (Y7) | | | | |
|---|---|---|---|---|---|---|
| Test time | hour | 0 | 162.8 | 190.5 | 197.5 | 214.2 |
| Amount of coking | mg/100 ml | 0 | 4.7 | 2.7 | 5.4 | 105.9 |
| Kinematic viscosity at 40° C. | $mm^2/s$ | 45.09 | 45.97 | 46.74 | 45.65 | 95.15 |
| Acid value | mgKOH/g | 0.13 | 0.37 | 0.44 | 0.15 | 24.6 |
| Millipore value | mg/100 ml | 0 | 0.1 | 0.3 | 0.7 | 2.1 |
| RPVOT value | min | 988 | 836 | 746 | 1000 | 14 |

TABLE 5-4

| Comparative Example 8 | | Lubricating oil composition (Y8) | | | | |
|---|---|---|---|---|---|---|
| Test time | hour | 0 | 119 | 142.2 | 168 | 192.5 |
| Amount of coking | mg/100 ml | 0 | 16.5 | 5.7 | 6.6 | 366.2 |
| Kinematic viscosity at 40° C. | $mm^2/s$ | 44.98 | 45.02 | 45.22 | 46.07 | 53.89 |
| Acid value | mgKOH/g | 0.01 | 0.03 | 0.08 | 0.34 | 4.72 |
| Millipore value | mg/100 ml | 0 | 0.6 | 0.9 | 0.5 | 0.8 |
| RPVOT value | min | 598 | 556 | 536 | 318 | 16 |

It can be said that the lubricating oil compositions (X1) to (X5) prepared in Examples 1 to 5 have a small amount of coking adhering to a panel in a panel coking test and a small Millipore value in an oxidation stability test even for long-term use in a high-temperature environment, and thus have a high effect of suppressing sludge generation. In addition, the lubricating oil compositions (X1) to (X5) have relatively small changes in the values of the kinematic viscosity and the acid value with respect to long-term use in a high-temperature environment, maintain a high RPVOT value even with respect to long-term use, maintain good oxidation stability, and have a long life.

On the other hand, in the lubricating oil compositions (Y1) to (Y8) prepared in Comparative Examples 1 to 8, in a relatively short time from the start of the test, the amount of coking adhering to the panel in the panel coking test increased, and a decrease in the RPVOT value was observed, resulting in a problem in terms of life.

The invention claimed is:

1. A lubricating oil composition, comprising:

a mineral base oil (A) having a temperature gradient Δ|Dt| of a distillation temperature of 6.8° C./% by volume or less between two points of a distillation amount of 2.0% by volume and a distillation amount of 5.0% by volume in a distillation curve; and an antioxidant (B) comprising an amine-based antioxidant (B1), a phenol-based antioxidant (B2), and a phosphorus-based antioxidant (B3), wherein the amine-based antioxidant (B1) is present in a range of from 0.50 to 3.5% by mass, based on a total lubricating oil composition mass, wherein the phenol-based antioxidant (B2) is present in a range of from 0.30 to 3.5% by mass, based on a total lubricating oil composition mass, wherein the content of the phosphorus-based antioxidant (B3) is in a range of from 0.06 to 1.0% by mass, based on the total lubricating oil composition mass, wherein the distillation temperature at the distillation amount of 2.0% by volume of the mineral base oil (A) is in a range of from 405 to 510° C., and wherein the distillation temperature at the distillation amount of 5.0% by volume of the mineral base oil (A) is in a range of from 425 to 550° C.

2. The composition of claim 1, wherein a (B2)/(B1) mass content ratio of the phenol-based antioxidant (B2) to the amine-based antioxidant (B1) is in a range of from 0.1 to 5.0.

3. The composition of claim 1, wherein a (B3)/(B1) mass content ratio of the phosphorus-based antioxidant (B3) to the amine-based antioxidant (B1) is in a range of from 0.01 to 0.60.

4. The composition of claim 1, wherein the amine-based antioxidant (B1) is present in a range of from 0.50 to 3.2% by mass, based on the total lubricating oil composition mass.

5. The composition of claim 1, wherein the phenol-based antioxidant (B2) is present in a range of from 0.50 to 3.0% by mass, based on the total lubricating oil composition mass.

6. The composition of claim 1, wherein the phosphorus-based antioxidant (B3) comprises a phosphorus atom comprising compound (B31) having a phenol structure.

7. The composition of claim 1, wherein the content of the antioxidant (B) is in a range of from 0.10 to 4.0% by mass, based on the total lubricating oil composition mass.

8. The composition of claim 1, wherein the phenol-based antioxidant (B2) is present in a range of from 0.50 to 2.5% by mass, based on the total lubricating oil composition mass.

9. The composition of claim 1, wherein the phenol-based antioxidant (B2) is present in a range of from 0.70 to 2.5% by mass, based on the total lubricating oil composition mass.

10. The composition of claim 1, wherein the amine-based antioxidant (B1) is present in a range of from 0.70 to 3.2% by mass, based on the total lubricating oil composition mass.

11. The composition of claim 1, wherein the amine-based antioxidant (B1) is present in a range of from 0.70 to 3.0% by mass, based on the total lubricating oil composition mass.

12. The composition of claim 1, wherein the amine-based antioxidant (B1) is present in a range of from 1.20 to 3.0% by mass, based on the total lubricating oil composition mass.

13. The composition of claim 1, wherein the phosphorus-based antioxidant (B3) has a formula (b3-1):

(b3-1)

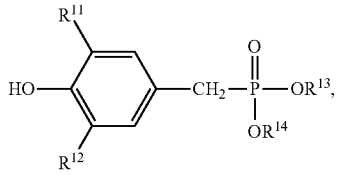

wherein $R^{11}$, $R^{12}$, $R^{13}$, and $R^{14}$ are independently H or an alkyl group having 1 to 30 carbon atoms.

14. The composition of claim 13, wherein, in the formula (b3-1), $R^{11}$, $R^{12}$, $R^{13}$, and $R^{14}$ are independently H or an alkyl group having 1 to 6 carbon atoms.

15. The composition of claim 1, wherein the amine-based antioxidant (B1) comprises a compound of formula (b1-1) and/or a compound of formula (b1-2):

(b1-1)

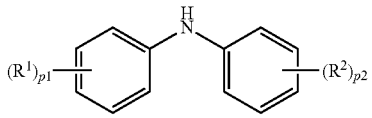

and/or (b1-2)

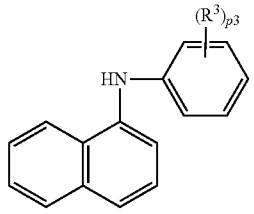

, wherein $R^1$, $R^2$, and $R^3$ are independently H or an alkyl group having 1 to 30 carbon atoms, and p1, p2, and p3 are independently an integer in a range of from 1 to 5.

16. The composition of claim 15, wherein the compound of formula (b1-2) is present and has an alkyl group having 1 to 20 carbon atoms.

17. The composition of claim 1, wherein the phenol-based antioxidant (B2) comprises 2,6-di-t-butyl-4-methylphenol, 2,6-di-tbutyl-4-ethylphenol, 2,4,6-tri-t-butylphenol, 2,6-di-t-butyl-4-hydroxymethylphenol, 2,6-di-t-butylphenol, 2,4-dimethyl-6-t-butylphenol, 2,6-di-t-butyl-4-(N,N-dimethylaminomethyl)phenol, 2,6-di-t-amyl-4-methylphenol, and/or benzenepropanoic acid-3,5-bis(1,1-dimethylethyl)-4-hydroxyalkyl ester.

18. The composition of claim 1, wherein the phenol-based antioxidant (B2) comprises 4,4'-methylenebis(2,6-di-t-butylphenol), 4,4'-isopropylidenebis(2-di-t-butylphenol), 2,2'-methylenebis(4-methyl-6-t-butylphenol), 4,4'-bis(2-methyl-6-t-butylphenol), 2,2'-methylenebis(4-ethyl-6-t-butylphenol), and/or 4,4'-butylidenebis(3-methyl-6-t-butylphenol).

19. The composition of claim 1, wherein the mineral base oil (A) is present in a range of from 60 to 99.9% by mass, based on the total lubricating oil composition mass.

20. The composition of claim 1, wherein the mineral base oil (A) is present in a range of from 85 to 98% by mass, based on the total lubricating oil composition mass.

* * * * *